US005623903A

United States Patent [19]

Ueda

[11] Patent Number: 5,623,903

[45] Date of Patent: Apr. 29, 1997

[54] IDLE SPEED CONTROL METHOD AND APPARATUS FOR AN INTERNAL COMBUSTION ENGINE

[75] Inventor: Katsunori Ueda, Tokyo, Japan

[73] Assignee: Mitsubishi Jidosha Kogyo Kabushiki Kaisha, Tokyo, Japan

[21] Appl. No.: 424,495

[22] PCT Filed: Oct. 12, 1994

[86] PCT No.: PCT/JP94/01707

§ 371 Date: May 18, 1995

§ 102(e) Date: May 18, 1995

[87] PCT Pub. No.: WO95/10699

PCT Pub. Date: Apr. 20, 1995

[30] Foreign Application Priority Data

Oct. 12, 1993 [JP] Japan ..... 5-254506

[51] Int. Cl.[6] ..... F02M 3/00

[52] U.S. Cl. ..... 123/339.23

[58] Field of Search ..... 123/339.23, 417; 364/431.07

[56] References Cited

U.S. PATENT DOCUMENTS

| | | | |
|---|---|---|---|
| 4,491,108 | 1/1985 | Hasegawa et al. | 123/339.23 |
| 4,640,244 | 2/1987 | Koike et al. | 123/339.23 |
| 4,705,001 | 11/1987 | Danno et al. | 123/417 |
| 5,083,541 | 1/1992 | Chen | 123/339.23 |
| 5,228,421 | 7/1993 | Orzel | 123/339.23 |
| 5,253,624 | 10/1993 | Anzai et al. | 123/339.23 |
| 5,313,395 | 5/1994 | Kawai et al. | 364/431.07 |

FOREIGN PATENT DOCUMENTS

| | | | |
|---|---|---|---|
| 58-187553 | 11/1983 | Japan | 123/339 |
| 58-187542 | 11/1983 | Japan | 123/339 |
| 61-81546 | 4/1986 | Japan | 123/339 |
| 63-75330 | 4/1988 | Japan | 123/339 |
| 63-235639 | 9/1988 | Japan | 123/339 |

*Primary Examiner*—Raymond A. Nelli

[57] ABSTRACT

It is determined whether or not the absolute value of a deviation ΔI between an electric load current value Ifbon at the start of idle speed feedback and a present electric load current value Iel is greater than a predetermined threshold value Xdiel (S31). If the absolute value of the deviation ΔI is smaller than the threshold value Xdiel, feedback control of an ISC valve is continued (S23). When the absolute value of the deviation ΔI becomes greater than the value Xdiel, countdown of a countdown timer (T) is started (S36), and the control mode is switched over to open-loop control to drive the ISC valve (S33) so that the value in the timer becomes 0 (S32), whereby idling is stabilized despite the fluctuation of the engine load.

7 Claims, 4 Drawing Sheets

IDLE SPEED CONTROL METHOD AND APPARATUS FOR AN INTERNAL COMBUSTION ENGINE

TECHNICAL FIELD

The present invention relates to an idle speed control method and apparatus for an internal combustion engine, and more particularly, to a method and an apparatus for improving the stability of idling when the engine load fluctuates.

BACKGROUND ART

In a known modern automotive internal combustion engine, a main suction passage is juxtaposed with a by-pass line for by-passing a throttle valve in order to keep the engine speed during idling operation (i.e., idling speed) at an optimum target speed depending on the engine load, and the by-pass line area is varied by means of an ISC valve (idle speed control valve) of the stepping-motor type. According to the engine of this type, an ECU (electronic control unit) used as a control device is supplied with load information for an air conditioner compressor, alternator, power steering pump, etc., besides operating information, such as the engine speed, cooling water temperature, etc. Based on these pieces of information, the ECU performs arithmetic processing and the like, and settles the drive step volume of the ISC valve which realizes a proper idle speed.

In general, speed feedback control is used as a mode of drive control for the ISC valve. If the idle speed is deviated from its target value (reference idle speed), according to this control, an intake correction value for eliminating the deviation is obtained by computation or map retrieval, and the ISC valve is driven to the opening or closing side in accordance with the intake correction value, whereby a stable idle speed can be obtained despite the variation of load. In recently developed speed feedback control, the speed feedback control is temporarily terminated when the air conditioner compressor, alternator, etc. are started or stopped, and is switched over to open-loop control such that only load correction is effected for a predetermined time, in order to prevent a control delay or overcontrolling when the load changes suddenly.

Normally, the aforesaid switching from the speed feedback control to the open-loop control is achieved as the load changing rate exceeds a predetermined threshold value. In doing this, the load changing rate is obtained by detecting the load with every predetermined sampling period, and dividing the resulting deviation by the sampling period. Thus, the control response characteristic can be improved by shortening the sampling period and lowering the threshold value. In this case, however, if the detected load involves a minute fluctuation or noises, the load changing rate is naturally liable to change suddenly, sometimes causing wrong operation.

If the sampling period and the threshold value are lengthened and increased, respectively, on the other hand, there is no possibility of wrong operation, and stable control can be effected. In this case, however, the value of the load changing rate is too small to ensure control switching if a large load change, if any, converges within the sampling period. Thus, the control response characteristic and the control stability are in tradeoff relation, and cannot be reconciled to a high degree. In order to prevent an engine stall or the like when the load changes suddenly, therefore, the reference idle speed must inevitably be set at a pretty high value, so that the fuel cost performance is worsened. In the case of an idle-cylinder engine in which the operation of some cylinders is stopped in a low-load state, moreover, idling becomes particularly unstable when the load fluctuates, causing a substantial vibration.

The object of the present invention is to provide an idle speed control method and apparatus for an internal combustion engine, ensuring stable idling despite a fluctuation of engine load.

DISCLOSURE OF THE INVENTION

In order to achieve the above object, according to the present invention, there are provided an idle speed control method and apparatus for an internal combustion engine, which adjusts the amount of intake air supplied to the internal combustion engine on the basis of the result of comparison between an actual engine speed and a target engine speed during idle operation of the internal combustion engine, and subjects the amount of intake air to speed feedback control so that the idle speed is kept on the level of the target speed.

According to the method and apparatus of the present invention, the load of the internal combustion engine is detected in predetermined detection periods; the detected load value obtained at the start of the speed feedback control control is stored as a reference value; a deviation between the detected load value and the reference value is obtained with every detection period during the speed feedback control; and the speed feedback control is temporarily terminated to subject the amount of intake air to open-loop control when a predetermined threshold value is exceeded by the deviation.

Load detecting means of the idle speed control apparatus may be arranged so as to detect the load of the internal combustion engine in accordance with the operating state of a generator. Preferably, in this case, the load detecting means detects the load of the internal combustion engine in accordance with the conduction rate of a field current supplied to a field coil of the generator.

Control means of the idle speed control apparatus nay be arranged so as to terminate the speed feedback control and execute the open-loop control for a set period when the predetermined threshold value is exceeded by the calculated deviation, and to restart the speed feedback control after the passage of the set period.

Preferably, in this case, the load storage means updates the reference value into each detected load value and stores the value while the speed feedback control is terminated.

In the control apparatus which uses an intake regulating valve to adjust the idle intake, the control means may control the valve opening of the intake regulating valve in accordance with a valve opening control parameter value set at settled control intervals, correct the valve opening control parameter value set in the last cycle in accordance with a deviation between the detected engine speed and the target engine speed and set the corrected value as a valve opening control parameter value for the present cycle during the speed feedback control, and set a basic parameter value in accordance with the temperature condition of the internal combustion engine, correct the basic parameter value in accordance with the detected load, and set the corrected value as a valve opening control parameter value for the present cycle during the open-loop control.

According to the present invention, the detected load value obtained at the start of the feedback control of the idle speed and the detected load value obtained during the feedback control are compared continually, and the feedback control is terminated when the predetermined threshold value is exceeded by the deviation between these values so that idle intake adjusting means is subjected to the open-loop control for a predetermined time. Thus, stable idle speed control can be effected quickly without wrong operation. In consequence, reduction of the idle speed and cylinder resting can be effected reasonably, and improvement of the fuel cost performance and reduction of vibration and noises can be achieved.

BEST MODE OF CARRYING OUT THE INVENTION

One embodiment of the present invention will now be described in detail with reference to the drawings.

Figure 1:
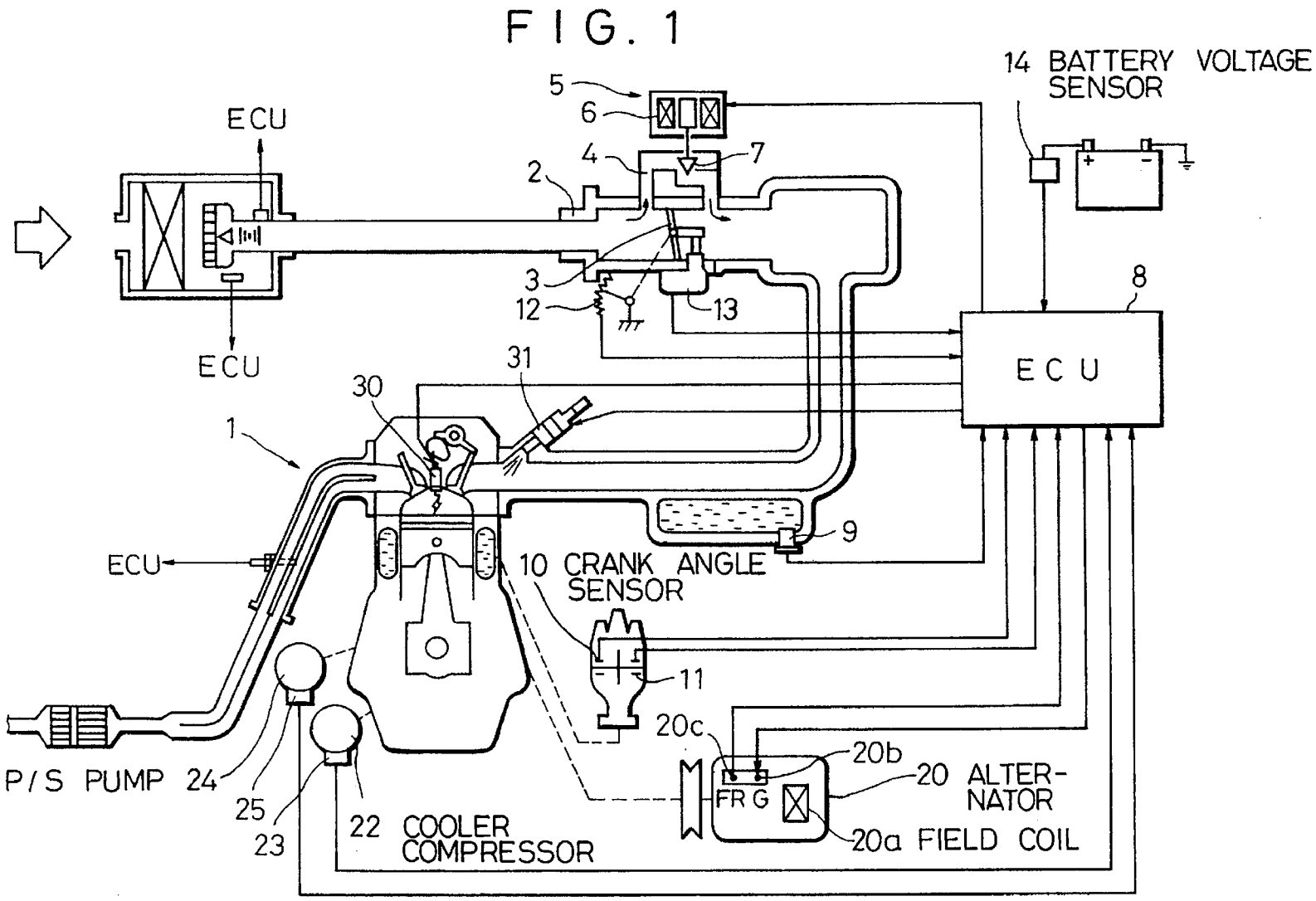
FIG. 1 is a schematic view showing an automotive engine to which an idle speed control apparatus according to the present invention is applied.

FIG. 1 shows an outline of an automotive engine to which an idle speed control apparatus according to the present invention is applied. In this drawing, a suction pipe 2 which forms a main suction passage of an engine 1 is provided with a throttle valve 3, and is juxtaposed with a by-pass line 4 through which intake air is allowed to flow by-passing the throttle valve 3. This by-pass line 4 is fitted with an ISC valve 5 for use as idle intake adjusting means, and the flow area is increased or decreased as the valve 5 is actuated. The ISC valve 5 is provided with a stepping motor 6 and a needle 7, and the stepping motor 6 is driven by an ECU 8, thereby moving the needle 7 up and down. Moreover, the engine 1 is fitted with an alternator 20, cooler compressor 22, pump 24 for power steering, etc., as auxiliary equipment (i.e., external load), which are driven by a crankshaft by means of a timing belt and the like.

The alternator 20 includes a stator (not shown), which is wound with a stator coil, and a rotor (not shown), which is wound with a field coil 20*a*. The output current of the field coil 20*a* is controlled by means of a field current which is supplied to the alternator 20 through a G terminal 20*b* (mentioned later).

On the other hand, the ECU 8 is provided with input and output devices, memory devices (nonvolatile RAM, ROM, etc.), central processing unit (CPU), timer counter, etc.(none of which is shown), and its input side is connected with a water temperature sensor 9 for detecting a cooling water temperature $W_T$ of the engine 1, a crank angle sensor 10 for detecting a predetermined crank angle position, a cylinder discriminating sensor 11 for detecting a first cylinder at a predetermined crank angle, a throttle sensor 12 for detecting the valve opening of the throttle valve 3, an idle switch 13 for detecting a fully-closed state of the throttle valve 3, a battery voltage sensor 14 for detecting a battery voltage Vb, etc., and receives detected information on the side of the engine 1. Also, the ECU 8 is connected with an FR terminal 20*c* for detecting a generative state of the alternator 20, an air conditioner switch 23 for detecting the operation of the cooler compressor 22, P/S switch 25 for detecting the load on the pump 24 for power steering, etc., and receives detected information on the auxiliary equipment side. When the level of the FR terminal 20*c* is LOW, a power transistor in a voltage regulator (not shown) is ON, so that the alternator 20 is generating electricity. Based on these pieces of detected information, the ECU 8 delivers driving signals to an ignition plug 30, a fuel injection valve 31, the stepping motor 6 of the ISC valve 5, the G terminal 20*b* for exciting the field coil 20*a* of the alternator 20, etc.

Referring now to the flowcharts of FIGS. 2 to 5, a control sequence for the idle speed with respect to the fluctuation of load, e.g., the load fluctuation of the alternator 20 in the present embodiment, will be explained.

Figure 2:
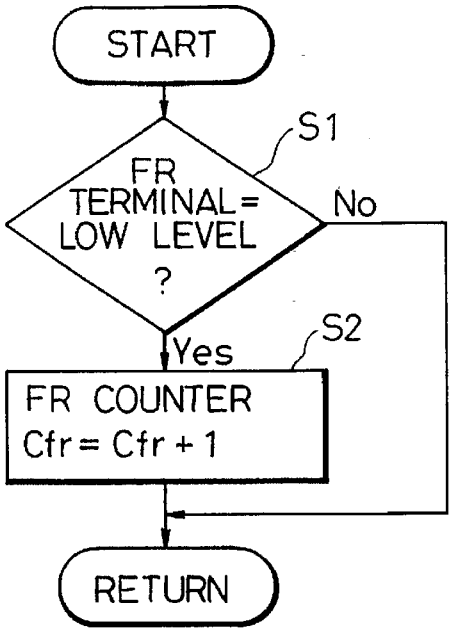
FIG. 2 is a flowchart for a power generation frequency counting subroutine showing steps of procedure for counting low-level inversion cycles of an FR terminal of an alternator.

When the engine 1 is started, the ECU 8 executes an power generation frequency counting subroutine for the alternator 20 shown in FIG. 2 at predetermined control intervals (0.25 ms in the present embodiment). In this subroutine, the ECU 8 determines in Step S1 whether or not the level of the FR terminal (i.e., field terminal) 20*c* of the alternator 20 is LOW. If the level is LOW, the ECU 8 adds 1 to a value Cfr in a built-in FR counter in Step S2. If the level is not LOW, the ECU 8 terminates the routine concerned without executing anything.

$$Cfr=Cfr+1 \tag{1}$$

Here the initial value of the FR counter value Cfr is set at 0.

Figure 3:
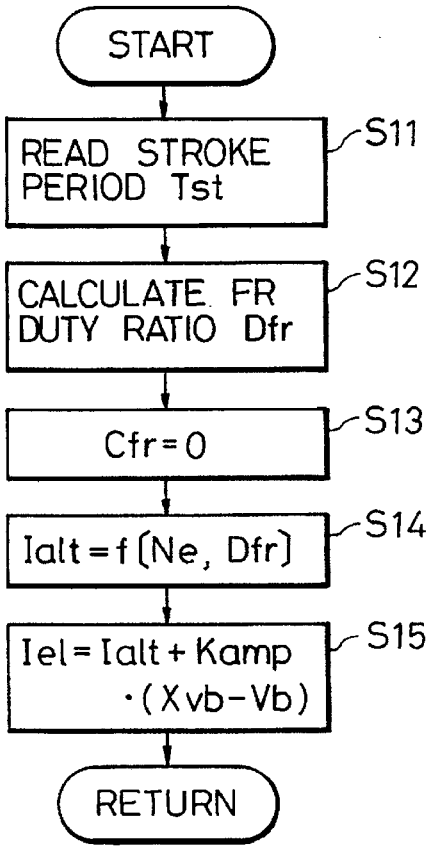
FIG. 3 is a flowchart for an electric load discriminating subroutine showing steps of procedure for calculating an electric load current value Iel to be outputted by the alternator.

Moreover, the ECU 8 executes an electric load discriminating subroutine of FIG. 3 every time a crank angle interruption signal from the crank angle sensor 10 is inputted. In this subroutine, the ECU 8 first reads a stroke period Tst of the engine 1 in Step S11. Then, in Step S12, the ECU 8 calculates an FR duty ratio Dfr which is indicative of the power generation rate, that is, the percentage at which the level of the FR terminal 21 becomes LOW in the stroke period Tst, according to equation (2) given as follows:

$$Dfr=(Cfr\times 0.25\ ms)/Tst. \tag{2}$$

After finishing the calculation of the FR duty ratio Dfr, the ECU 8 resets the FR counter in Step S12. Then, using a two-dimensional map (not shown), the ECU 8 calculates a generated current Ialt of the alternator 20 in accordance with an engine speed Ne and the FR duty ratio Dfr, in Step S13.

$$Ialt=f[Ne, Dfr]. \tag{3}$$

After finishing the calculation of the generated current Ialt, the ECU 8 calculates an electric load current value Iel according to the following equation (4) using a reference voltage Xvb of a battery (not shown) and a present battery voltage Vb, in Step S15.

$$Iel=Ialt+Kamp\times(Xvb-Vb). \tag{4}$$

Here Kamp is a conversion coefficient for converting a voltage change of the battery into a current change (load change).

The reason why correction is carried out corresponding to the change of the battery voltage Vb is that the load current is expected to increase in a short time if the battery voltage Vb drops. Thus, the control response characteristic can be improved. In the case where there is a relation Vb>Xvb, voltage correction which entails reduction of load is not carried out, and Iel=Ialt is given.

Figure 4:
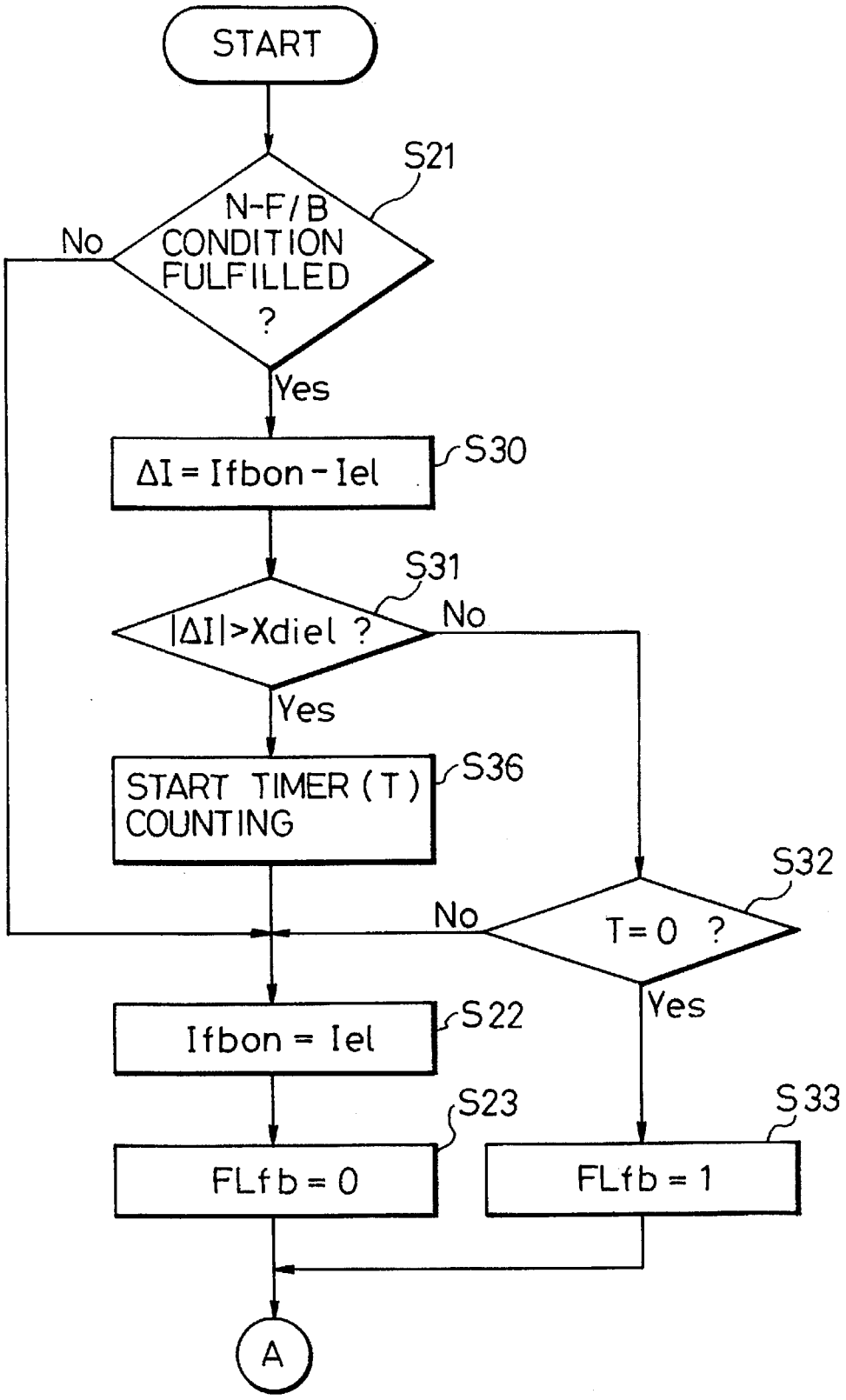
FIG. 4 is a flowchart for the first half of an ISC valve drive control subroutine showing steps of procedure for ISC valve drive control.
Figure 5:
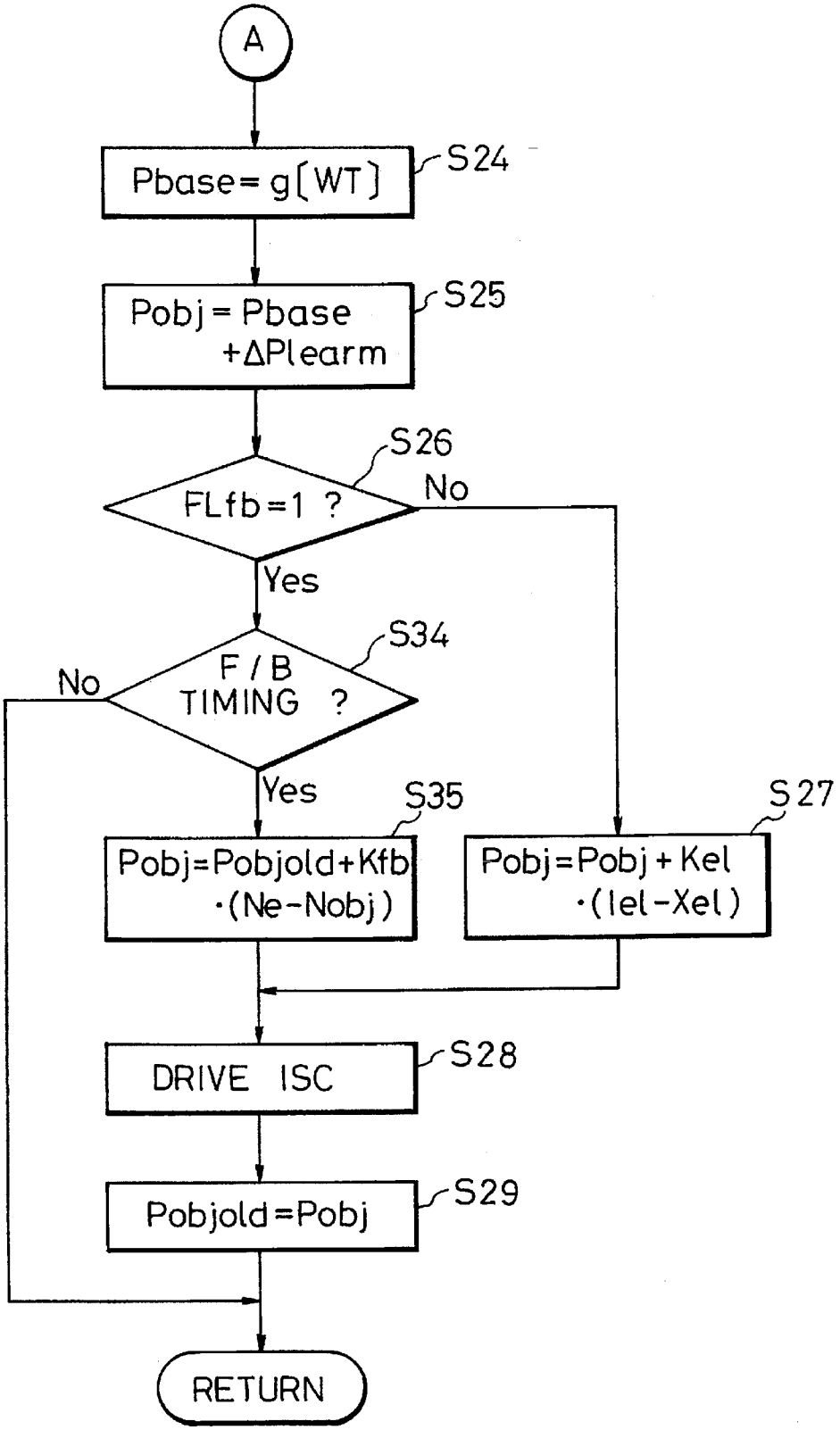
FIG. 5 is a flowchart for the second half of the ISC valve drive control subroutine subsequent to FIG. 4.

On the other hand, the ECU 8 executes an ISC valve drive control subroutine shown in FIGS. 4 and 5 at predetermined control intervals (0.25 ms in the present embodiment). In this subroutine, the ECU 8 first determines in Step S21 of FIG. 4 whether or not a condition for speed feedback (hereinafter referred to as N-F/B condition) is fulfilled. The decision value of this determination is positive (Yes) when it is all concluded that the idle switch 13 is ON, that a predetermined time (1.0 second in the present embodiment) has passed after the start of operation, that the cooling water temperature $W_T$ is not lower than a predetermined value, that a predetermined time (3.0 seconds in the present embodiment) or a longer time has passed after a reduction of the engine speed Ne from a target speed Nobj to a predetermined speed (300 rpm in the present embodiment).

If the N-F/B condition is not fulfilled in Step S21 immediately after the start of operation of the engine 1 or in any other situation, the ECU 8 advances to Step S22, whereupon it stores in a memory with the electric load current value Iel obtained according to the aforesaid equation (4) as a feedback starting load current value Ifbon. In Step S23, moreover, the ECU 8 sets a feedback control flag FLfb at 0, and stores open-loop speed control to be executed.

$$Ifbon=Iel \tag{5}$$

Then, the ECU 8 advances to Step S24 of FIG. 5, whereupon it retrieves a basic opening Pbase of the ISC valve 5 from a map in accordance with the cooling water temperature $W_T$. Further, the ECU 8 adds a learning correction value ΔPlearn to the ISC basic opening Pbase, thereby calculating an ISC target opening Pobj (Step S25).

$$Pobj=Pbase+\Delta Plearn. \tag{6}$$

The learning correction value ΔPlearn is obtained as a time average of variations of the ISC basic opening Pbase, for example.

Then, in Step S26, the ECU 8 determines whether or not the feedback control flag FLfb is 1. Since this control flag FLfb is set at 0 in Step S23, the ECU 8 advances to Step S27, whereupon it subjects the ISC target opening Pobj to electric load correction according to the following equation (7) using the electric load current value Iel.

$$Pobj=Pobj+Kel\cdot(Iel-Xel). \tag{7}$$

Here Kel is a conversion coefficient, and Xel is a reference current value for electric load correction. Based on the second term of the right side of equation (7), an auxiliary intake corresponding to the electric load is supplied through the by-pass line 4 to the engine 1.

Then, the ECU 8 drives the ISC valve 5 on the basis of the ISC target opening Pobj in Step S28. Finally, the ECU 8 stores the ISC target opening Pobj as the last opening Pobjold in Step S29, whereupon the routine concerned is finished.

$$Pobjold=Pobj. \tag{8}$$

If the N-F/B condition is not fulfilled, this control sequence is repeated, and the feedback starting load current value Ifbon and the last opening Pobjold are updated for each cycle in Steps S22 and S27.

If the N-F/B condition is fulfilled in Step S21 of FIG. 4 after warm-up of the engine 1 or the like is finished, on the other hand, the ECU 8 advances to Step S30, whereupon it starts speed feedback Control of the ISC valve 5. In Step S30, the ECU 8 first calculates a deviation ΔI between the feedback starting load current value Ifbon and the present electric load current value Iel.

$$\Delta I=Ifbon-Iel. \tag{9}$$

Then, in Step S31, the ECU 8 determines whether or not the absolute value of the deviation ΔI is greater than a predetermined threshold value Xdiel, that is, whether or not the control mode should be switched over to the open-loop control.

$$|\Delta I|>Xdiel. \tag{10}$$

If the absolute value of the deviation ΔI is smaller than the threshold value Xdiel, the ECU 8 concludes in Step S81 that the feedback control should be continued, and advances to Step S32. In Step S32, the ECU 8 determines whether or not the value in a countdown timer (T) is 0. If this value is 0, the ECU 8 sets the feedback control flag FLfb at 1 in Step S33. The initial value in the countdown timer (T) is 0, and the value in the countdown timer (T) is 0 if the aforesaid decision in Step S81 immediately after the start of feedback is negative (No).

Subsequently, the ECU 8 advances to Steps S24 and S25 of FIG. 5, whereupon it calculates the ISC target opening Pobj, and then advances to Step S26. Since the feedback control flag FLfb is set at 1 at this time, the ECU 8 advances from Step S26 to Step S34. In Step S34, the ECU 8 determines whether or not the present point of time is a timing for feedback (hereinafter referred to as F/B). The F/B timing is used to determine whether or not a necessary period (1.0 second in the present embodiment) for the stabilization of the engine speed Ne has elapsed after the last actuation of the ISC valve 5. The feedback control is not effected during this period in order to prevent hunting, and the routine concerned is finished without executing Step S35 and the subsequent steps. The aforesaid processes are repeated as long as the decisions in Steps S21 and S31 are positive (Yes) and negative (No), respectively.

If it is concluded in Step S34 that the present point of time is the F/B timing, the ECU 8 advances to Step S35, whereupon it calculates the ISC target opening Pobj according to equation (11) given as follows:

$$Pobj=Pobjold+Kfb\cdot(Ne-Nobj), \tag{11}$$

where Kfb is a feedback proportional gain, and, as mentioned in the above, Ne and Nobj are the engine speed and a target speed, respectively.

When the ISC target opening Pobj is obtained, the ISC valve 5 is driven in Step S28, and the ISC target opening Pobj is stored as the last opening Pobjold in Step S29, whereupon the routine concerned is finished.

If it is concluded in Step S31 that the load is changed so that the absolute value of the deviation ΔI is greater than the threshold value Xdiel, on the other hand, the ECU 8 concludes that the feedback control should be interrupted to effect the open-loop control, and advances to Step S36. In Step S36, the ECU 8 sets the countdown timer (T) at a predetermined value α, and starts countdown. The predetermined value α is adjusted to a suitable value such that idling can be quickly settled down by the open-loop control based on the load fluctuation. Then, as in the case where the N-F/B condition is not fulfilled, the ECU 8 executes Steps S22 to S29, thereby effecting the drive of the ISC valve 5 based on the open-loop control, and updates the feedback starting load current value Ifbon and the last opening Pobjold. If the electric load fluctuates, the electric load current value Iel is also newly set, so that the feedback starting load current value Ifbon and the last opening Pobjold are also modified.

When the open-loop control is started, the ISC target opening Pobj changes suddenly, and the feedback starting load current value Ifbon is updated in Step S22, so that the absolute value of the deviation ΔI approaches 0. Accordingly, the decision in Step S31 is negative (No), so that the ECU 8 advances to Step S32. Before the value in the countdown timer (T) becomes 0, however, the decision in Step S32 is negative (No), so that the ECU 8 advances to Step S22, whereupon it repeats the open-loop control for a period corresponding to the set value α in the countdown timer (T).

When the value in the countdown timer (T) becomes 0, the ECU 8 advances from Step S32 to Step S33, whereupon it carries out the feedback control again. Also during the open-loop control, in this case, the last opening Pobjold as the initial value for the feedback control is updated continually, so that the value of the ISC target opening Pobj calculated in Step S35 is appropriate enough to prevent the engine speed Ne from changing suddenly.

The aspect of the present invention is not limited to this embodiment. Although the electric load of the alternator is used as the engine load according to the embodiment described above, for example, the engine load may alternatively be the cooler compressor, pump for power steering, etc. In this case, the mechanical load of the cooler compressor or the like may be converted into an electric load so that it can be added to the electric load current value Iel as the electric load.

According to the embodiment described herein, moreover, the ISC valve of the by-pass type is used as the idle intake adjusting means. Alternatively, however, an ISC valve of the direct-acting type may be used which adjusts the idle intake by changing the opening of the throttle valve.

I claim:

1. An idle speed control method for an internal combustion engine, which adjusts the amount of intake air supplied to said internal combustion engine on the basis of the result of comparison between an actual engine speed and a target engine speed during idle operation of the internal combustion engine, and subjects the amount of intake air to speed feedback control so that the idle speed is kept on the level of the target speed, comprising steps of:

detecting the load of said internal combustion engine in predetermined detection periods;

storing the detected load value obtained at the start of said speed feedback control as a reference value;

obtaining a deviation between the detected load value and said reference value with every detection period during said speed feedback control; and temporarily terminating said speed feedback control to subject the amount of intake air to open-loop control when a predetermined threshold value is exceeded by said deviation.

2. An idle speed control apparatus for an internal combustion engine, which includes idle intake adjusting means for adjusting the amount of intake air during idle operation, and control means for subjecting said idle intake adjusting means to speed feedback control on the basis of the result of comparison between an actual engine speed and a target engine speed so that the idle speed is kept on the level of the target speed, said control apparatus comprising:

load detecting means for detecting the load of said internal combustion engine in predetermined detection periods;

load storage means for storing the detected load value obtained at the start of said speed feedback control as a reference value; and arithmetic means for calculating a deviation between the detected load value detected by said load detecting means and said reference value with every detection period during said speed feedback control, said control means temporarily terminating said speed feedback control to subject said idle intake adjusting means to open-loop control when a predetermined threshold value is exceeded by the deviation calculated by said arithmetic means.

3. A control apparatus according to claim 2, wherein said internal combustion engine includes a battery and a generator for charging the battery, and said load detecting means detects the load of said internal combustion engine in accordance with the operating state of said generator.

4. A control apparatus according to claim 3, wherein said generator includes a field coil, and said load detecting means detects the load of said internal combustion engine in accordance with the conduction rate of a field current supplied to said field coil.

5. A control apparatus according to claim 2, wherein said control means terminates said speed feedback control and executes said open-loop control for a set period when said predetermined threshold value is exceeded by said calculated deviation, and restarts said speed feedback control after the passage of said set period.

6. A control apparatus according to claim 2, wherein said load storage means updates said reference value into each detected load value detected by said load detecting means and stores the value while said speed feedback control is terminated.

7. A control apparatus according to claim 2, further comprising temperature detecting means for detecting a temperature condition of the internal combustion engine, and wherein said idle intake adjusting means includes a needle for adjusting the intake, and said control means controls the valve opening of said needle in accordance with a valve opening control parameter value set at settled control intervals, corrects the valve opening control parameter value set in the last cycle in accordance with a deviation between the detected engine speed and the target engine speed and sets the corrected value as a valve opening control parameter value for the present cycle during said speed feedback control, and sets a basic parameter value in accordance with the temperature condition of the internal combustion engine detected by said temperature detecting means, corrects said basic parameter value in accordance with the load detected by said load detecting means, and sets the corrected value as a valve opening control parameter value for the present cycle during said open-loop control.

* * * * *